US007628636B2

(12) United States Patent
Yu et al.

(10) Patent No.: US 7,628,636 B2
(45) Date of Patent: Dec. 8, 2009

(54) ELECTRICAL CONNECTOR

(75) Inventors: Chao Hsueh Yu, Taipei (TW); Chien Tsai Hui, Taipei (TW); Katsuhiko Kobayashi, Taipei (TW)

(73) Assignees: Tyco Electronics AMP K.K., Kanagawa-ken (JP); Tyco Holdings (Bermuda) VII Ltd., Pembroke (BM)

( * ) Notice: Subject to any disclaimer, the term of this patent is extended or adjusted under 35 U.S.C. 154(b) by 0 days.

(21) Appl. No.: 11/951,758

(22) Filed: Dec. 6, 2007

(65) Prior Publication Data

US 2008/0139032 A1 Jun. 12, 2008

(30) Foreign Application Priority Data

Dec. 8, 2006 (JP) ..... 2006-332533

(51) Int. Cl.
*H01R 13/627* (2006.01)

(52) U.S. Cl. ..... 439/352; 439/372

(58) Field of Classification Search ..... 439/350, 439/352, 353, 358, 372
See application file for complete search history.

(56) References Cited

U.S. PATENT DOCUMENTS 5,090,916 A * 2/1992 Magnier ..... 439/352
5,154,629 A * 10/1992 Carver et al. ..... 439/352
5,383,794 A 1/1995 Davis et al.
5,713,752 A 2/1998 Leong et al.
6,371,789 B1 4/2002 Sato et al.
6,758,695 B2 * 7/2004 Pepe et al. ..... 439/608
6,945,808 B1 9/2005 Hisamatsu
2003/0236017 A1 12/2003 Waddell et al.

FOREIGN PATENT DOCUMENTS

JP 07272793 10/1995
JP 2003297482 10/2003

OTHER PUBLICATIONS

European Search Report for EP07122430, dated Mar. 27, 2009.

* cited by examiner

*Primary Examiner*—Tho D Ta
*Assistant Examiner*—Travis Chambers
(74) *Attorney, Agent, or Firm*—Barley Snyder LLC

(57) ABSTRACT

An electrical connector for connection to a complementary electrical connector is disclosed. The electrical connector includes a housing having a concavity and a latch rotatably carried by the housing. The latch includes a rotary section having a first curved edge, a second curved edge, and a tab received that is received by the concavity. The latch further includes a lock extending from the rotary section for connection with the complementary electrical connector.

13 Claims, 8 Drawing Sheets

ELECTRICAL CONNECTOR

CROSS-REFERENCE TO RELATED APPLICATION DATA

This application claims the benefit of the earlier filed Japanese Patent Application No. 2006-332533 having a filing date of Dec. 8, 2006.

FIELD OF THE INVENTION

The present invention relates to an electrical connector.

BACKGROUND

Electrical connectors having lock mechanisms for keeping the electrical connectors connected to their counterpart connectors are known.

For example, Japanese Patent Application Laid-open Publication No. 2003-297482 discloses a connector in which a lock lever is supported by its rotation-center shaft rotatable relative to the connector main body. When this connector is mated to connect with its counterpart connector, the lock lever rotates about their rotation-center shafts and the connector engages with its counterpart connector. This prevents the connector main body from being disconnected from its counterpart connector unintentionally. Nevertheless, the connector as recited in this patent document has drawbacks as follows. First, the connector main body has a structure in which its lock lever is supported by its rotation-center shaft consisting of a pin. This increases the number of parts. Second, manufacturing this connector requires a larger number of steps associated with installing the lock levers in the connector main body.

By contrast, Japanese Patent Application Publication No. 7-272793 discloses a card connector including a card discharging mechanism with a structure in which an arm bar for pushing a card out of the card connector is rotatably supported, without using a pin, to its lift blade that is a part of the main body.

In the case of assembling the card connector as recited in the latter patent document, the arm bar is fixed, like a rivet, to its lift blade made of a metallic plate as follows. Specifically, a cylindrical rotary shaft is formed in the lift blade by burring, and then the front end of the rotary shaft is expanded in the radial directions with the rotary shaft passing through an opening formed in the arm bar. This requires specialized steps for performing the burring process and expanding the front end of the shaft, as well as requiring facilities for the processes.

SUMMARY

The present invention, in one embodiment, relates to an electrical connector for connection to a complementary electrical connector. The electrical connector includes a housing having a concavity and a latch rotatably carried by the housing. The latch includes a rotary section having a first curved edge, a second curved edge, and a tab received that is received by the concavity. The latch further includes a lock extending from the rotary section for connection with the complementary electrical connector.

DETAILED DESCRIPTION OF THE EMBODIMENT(S)

Descriptions will be provided below for an embodiment of an electrical connector according to the present invention with reference to the drawings.

Figure 1A:
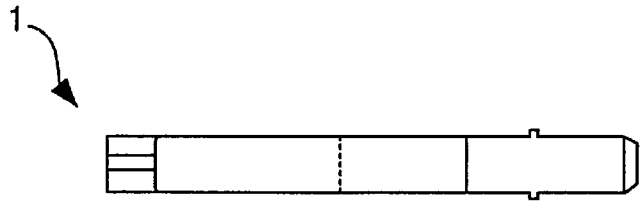
FIG. 1A is a right side orthogonal view of an electrical connector according to an embodiment of the present invention.
Figure 1B:
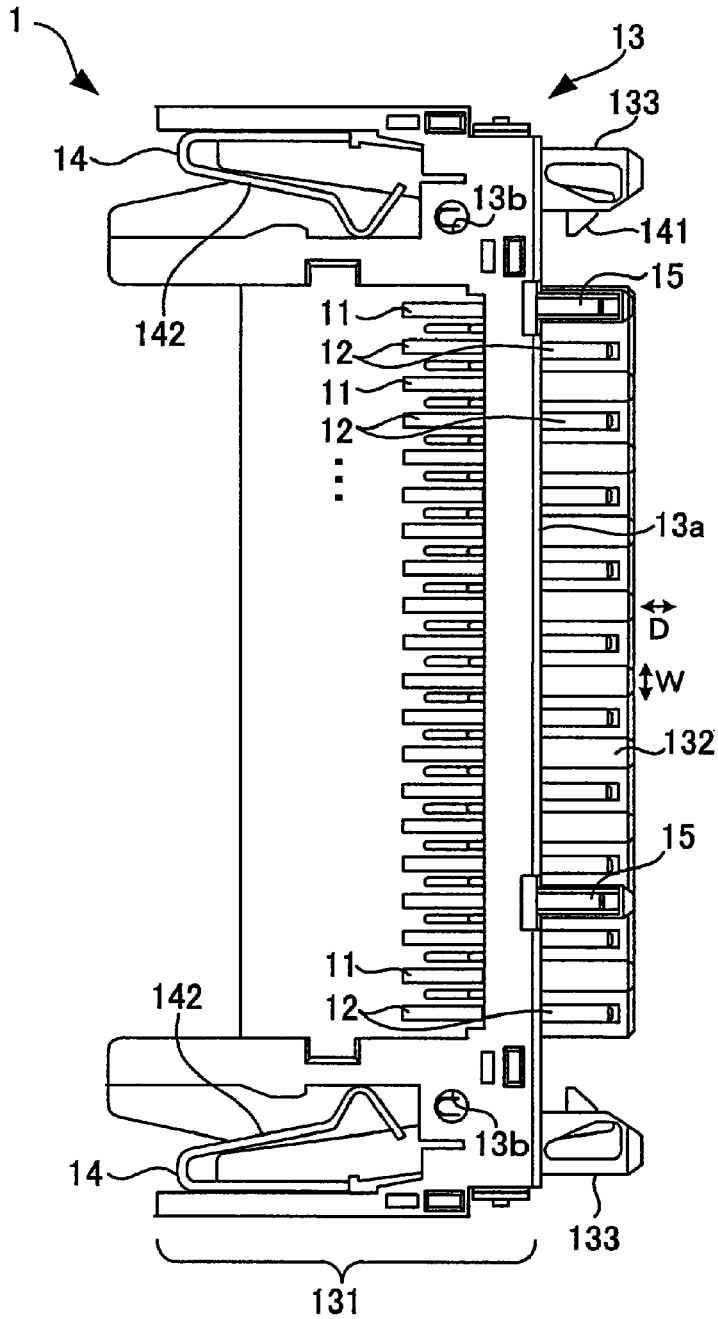
FIG. 1B is an orthogonal plan view of the electrical connector of FIG. 1A.
Figure 1C:
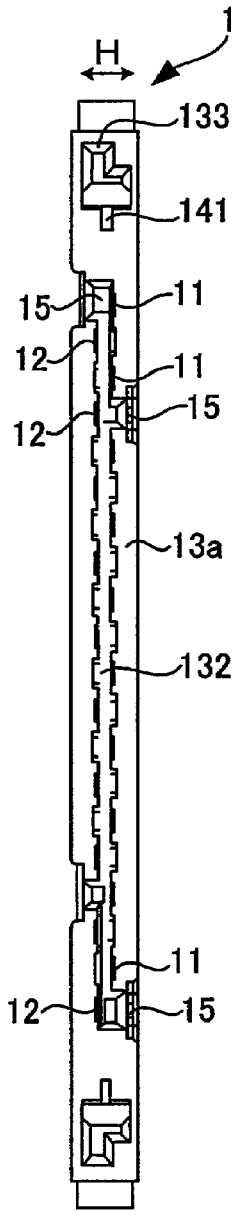
FIG. 1C is an orthogonal front view of the electrical connector of FIG. 1A.

FIGS. 1A-1C an electrical connector according to an embodiment of the present invention. The electrical connector 1 is used in conjunction with a complementary electrical connector 2 (see FIGS. 2A-2C), which will be described later. The electrical connector 1 electrically connects electric wires to a board. The electrical connector 1 is mated with the complementary electrical connector 2 (see FIGS. 2A-2C) as its counterpart connector, with its front shown in FIG. 1C being faced toward the complementary electrical connector 2. The electrical connector 1 comprises: multiple first contacts 11 and multiple second contacts 12 that carry an electrical connection between the electrical connector 1 and the complementary electrical connector 2; an insulating housing 13 that holds first and second contacts 11 and 12; and latches 14 that are engaged with the complementary electrical connector 2. The electrical connector 1 is actually used with a shield 16, a metallic shielding cover (see FIG. 3), attached to the outer periphery of a main body 131 of the housing 13. FIGS. 1A-1C shows the electrical connector 1 with the shield 16 being removed from the body 131 for increased viewing clarity.

The housing 13 includes the main body 131 and a plate-shaped mating plate 132 protruding out in a mating direction D from an abutment surface 13*a* in the body 131, which abuts the complementary electrical connector 2. The mating plate 132 extends in the same width direction W as the housing 13 extends. In addition, a pair of guides 133 protrude out, in the same direction as the mating plate 132, from the two respective ends of the abutment surface 13*a* with the mating plate 132 being therebetween in the width direction W. The housing 13 is made of an insulating resin material. The body 131, the mating plate 132 and the guides 133 are formed integrally into the housing 13.

The first and second contacts 11 and 12 are arranged in rows in the same width direction W as the mating plate 132 extends, on the two surfaces of the mating plate 132. The first and second contacts 11 and 12 are alternately arranged in a staggering manner on the two surfaces of the mating plate 132. The first and second contacts 11 and 12 extend from the mating plate 132 to the body 131, and are arranged in a single row in the body 131. Multiple electric wires that are not illustrated, are connected to the first and second contacts 11 and 12 on the body 131, by soldering or the like.

The latches 14 are attached to the two sides of the housing 13 in the width direction W. In addition, column-shaped supporting openings 13*b* are formed in the housing 13. The latches 14 are rotatably supported by the housing 13 and rotate about the insides of the supporting openings 13*b*, respectively. Each of the latches 14 includes a lock 141 which is locked into the complementary electrical connector 2. In response to a rotation of the latch 14, the lock 141 juts out from its guide 133, or retracts into the guide 133. Furthermore, each of the latches 14 includes a spring 142. A biasing force is applied by this spring 142 in the same direction as the lock 141 juts out from the guide 133.

Descriptions will be subsequently provided for the complementary electrical connector 2, the counterpart connector to the electrical connector 1.

Figure 2A:
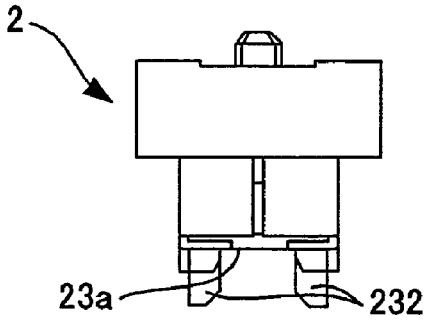
FIG. 2A is a right side orthogonal view of a complementary electrical connector according to an embodiment of the present invention.
Figure 2B:
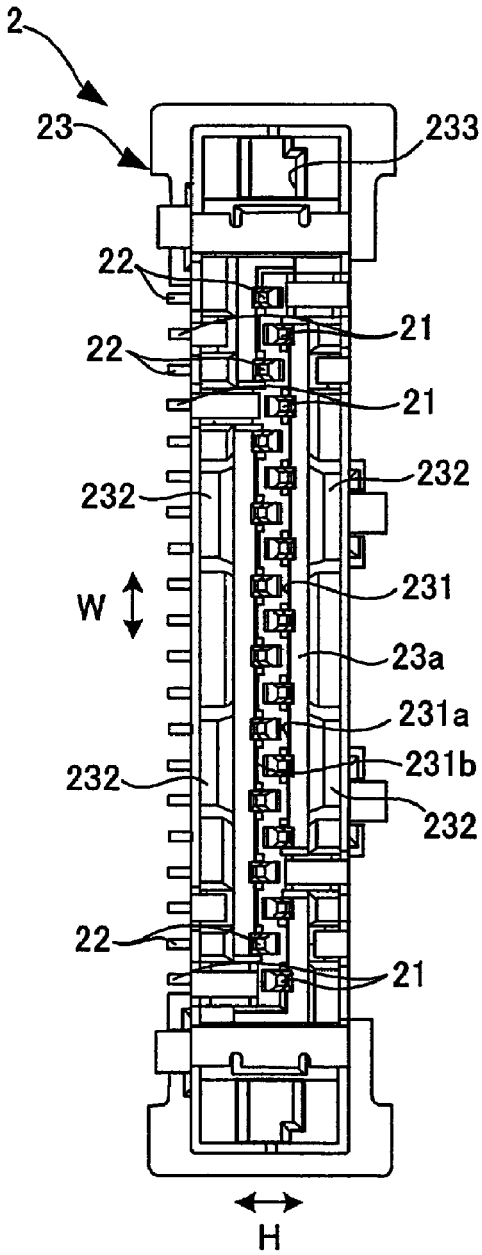
FIG. 2B is an orthogonal front view of the complementary electrical connector of FIG. 2A.
Figure 2C:
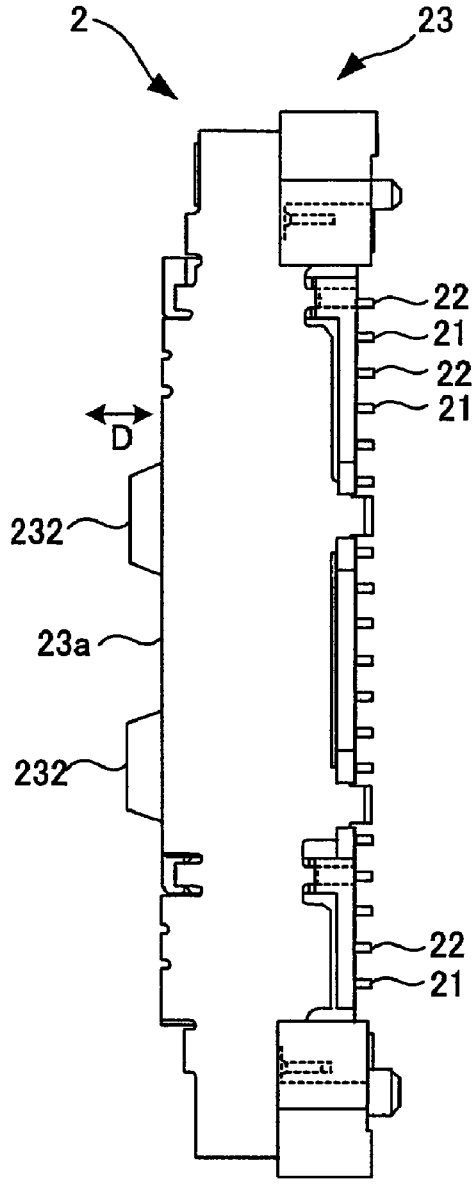
FIG. 2C is an orthogonal plan view of the complementary electrical connector of FIG. 2A.

The complementary electrical connector 2 shown in FIGS. 2A-2C includes first and second complementary contacts 21 and 22, and an insulating complementary housing 23 which holds these first and second complementary contacts 21 and 22. The complementary housing 23 is provided with an elongated mating groove 231 which is open to a complementary abutment surface 23*a* to abut the electrical connector 1. The first and second complementary contacts 21 and 22 are arranged side by side, in the same direction as the mating groove 231 extends, i.e., in the width direction W, on first and second complementary sidewalls 231*a* and 231*b* on the two sides of the mating groove 231. The first and second complementary contacts 21 and 22 are alternately arranged in a staggering manner on the first and second mating groove sidewalls 231*a* and 231*b* of the mating groove 231. The first and second complementary contacts 21 and 22 are arranged in a row. In addition, the first and second complementary contacts 21 and contacts 22 are arranged to jut from a surface on the opposite side of the complementary abutment surface 23*a* of the complementary housing 23, and their jutting parts are folded. The first and second complementary contacts 21 and 22 are connected to a board (not illustrated) by soldering or the like. In addition, a pair of guide openings 233 are provided respectively to the two sides of the complementary housing 23 with the mating groove 231 being therebetween in the width direction W. Each of the guide openings 233 is continuously provided with a locking opening 233*b* (see FIG. 8A). The lock 141 (see FIGS. 1A-1C) in the electrical connector 1 is locked into the locking opening 233*b*. Holding protrusions 232, which hold the electrical connector 1 from both sides, are provided to protrude from the complementary abutment surface 23*a* of the complementary housing 23 in the same mating direction D as the holding protrusions 232 are mated into the electrical connector 1.

Figure 3:
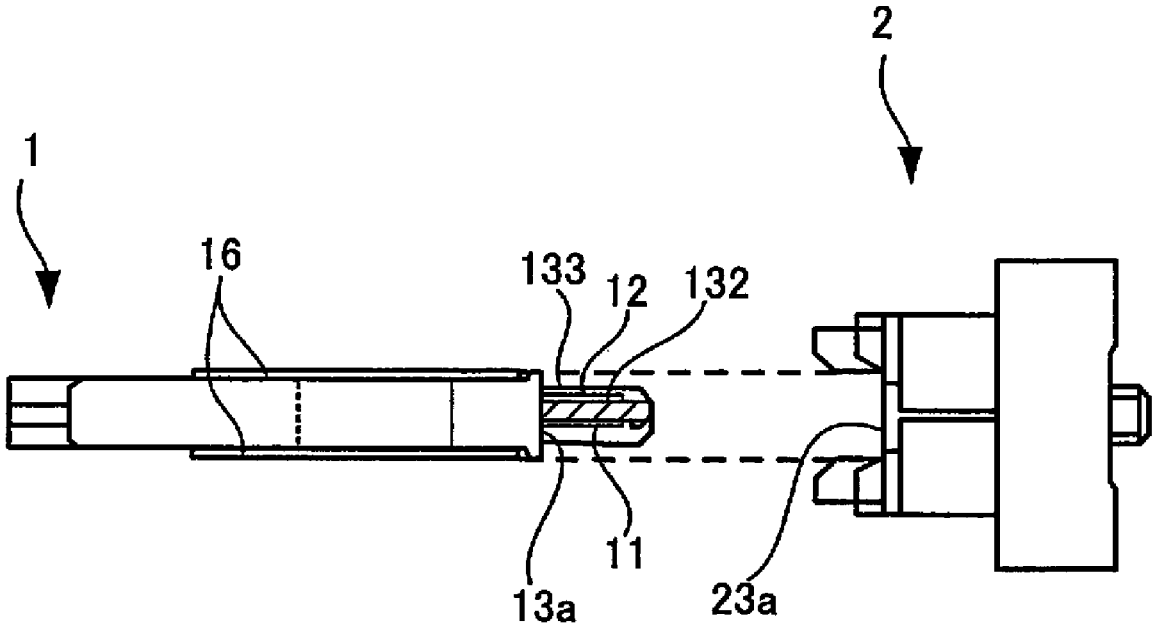
FIG. 3 is a schematic showing how the electrical connector of FIG. 1A is connected to the complementary electrical connector of FIG. 2A.

FIG. 3 is a diagram illustrating how the electrical connector 1 shown in FIGS. 1A-1C is connected to the complementary electrical connector 2 shown in FIG. 2A-2C. FIG. 3 shows the electrical connector 1 with the shield 16 being attached thereto. In addition, FIG. 3 shows how the mating plate 132 of the electrical connector 1 looks when seen through.

The electrical connector 1 and the complementary electrical connector 2 are connected to each other with their fronts facing each other so that the abutment surface 13*a* of the electrical connector 1 abuts on the complementary abutment surface 23*a* of the complementary electrical connector 2. In that position, the mating plate 132 of the electrical connector 1 is fitted into the mating groove 231 (see FIGS. 2A-2C) of the complementary electrical connector 2. Thereby, the first and second contacts 11 and 12 contact the first and second complementary contacts 21 and 22 (see FIG. 2A-2C), respectively. Furthermore, the guides 133 of the electrical connector 1 are fitted into the guide openings 233 of the complementary electrical connector 2.

Figure 4:
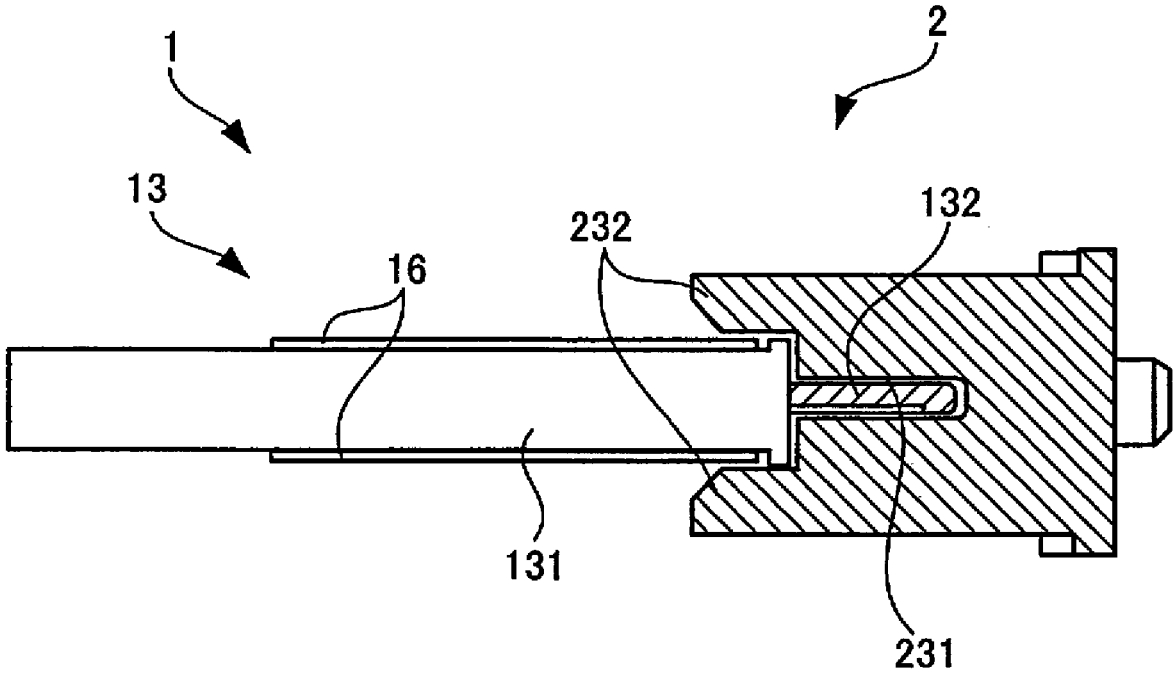
FIG. 4 is a cross-sectional view showing a state in which the electrical connector of FIG. 1A is connected to the complementary electrical connector of FIG. 2A.

As shown in FIG. 4, each of the holding protrusions 232 of the complementary electrical connector 2 is provided in a way that the holding protrusion 232 has a space whose height is almost equal to the height of the electrical connector 1 with the shield 16 being attached thereto. For this reason, while the electrical connector 1 and the complementary electrical connector 2 are mated with each other, the body 131 of the housing 13 in the electrical connector 1 is held between the two holding protrusion 232 in the complementary electrical connector 2. This restrains the electrical connector 1 from moving in a direction in which the mating plate 132 hollows or is partially removed from the mating groove 231 of the complementary electrical connector 2, even if an external force is applied to the electrical connector 1 while the electrical connector 1 is mated with the complementary electrical connector 2. This accordingly prevents the mating plate 132 from being damaged.

Figure 5A:
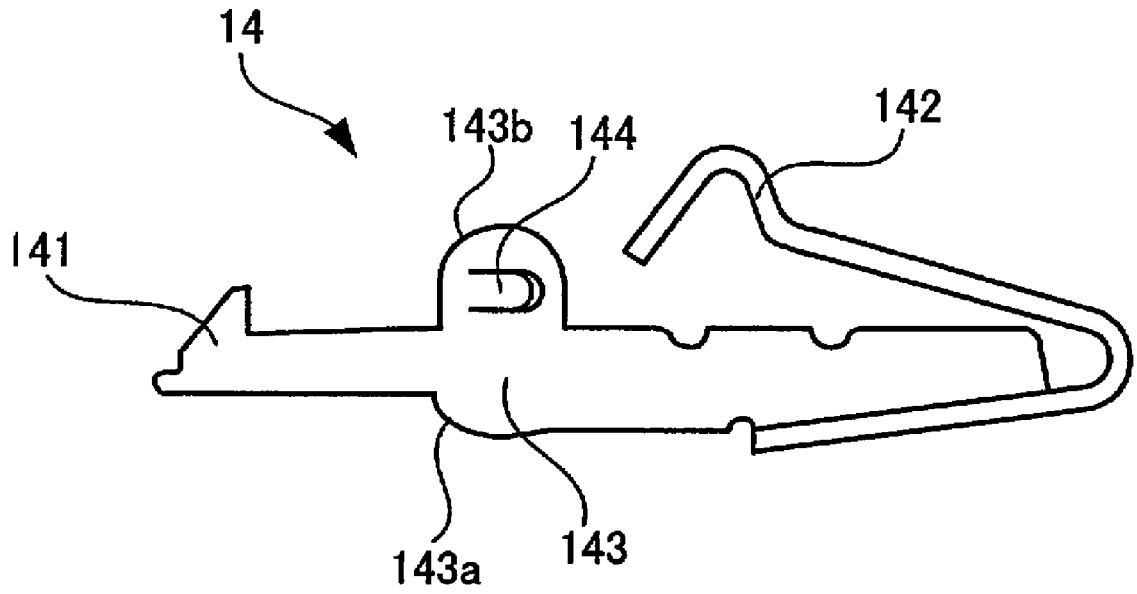
FIG. 5A is an orthogonal view of a latch of the electrical connector of FIG. 1A.
Figure 5B:
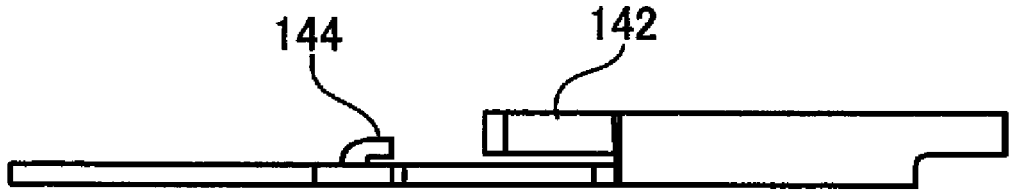
FIG. 5B is another orthogonal view of the latch of FIG. 5A.

As shown in FIGS. 5A-5B, the latch member 14 is a member formed by punching a corresponding piece out of a metallic plate and folding the punched-out piece. The latch member 14 includes: a plate-shaped rotary section 143; the hook-shaped lock 141 provided continuously from the rotary section 143; and the spring 142 continuously provided from the rotary section 141, in an integrated manner. First and second curved edges 143*a* and 143*b* are formed in the periphery of the rotary section 143. The lock 141 extends from between the first and second curved edges 143*a* and 143*b*. The rotary section 143 is provided with a tab 144. The tab 144 has a shape obtained by shearing a part of the rotary section 143 substantially into a U shape, and by folding up the sheared part. As shown in FIG. 5B in detail, the tab 144 is shaped like a hook in a manner that: a portion the tab 144 connected to the rotary section 143 is folded up at an almost right angle to the rotary section 143; and its middle portion is additionally bent so that its front end portion is almost in parallel with the rotary section 143. This tab 144 is formed by shearing its corresponding part from the rotary section 143 substantially in the form of a U shape, and bending the sheared part.

The present invention provides a cost-saving electrical connector 1 in which a latch 14 is easily installed. Specifically, the rotary functionality of the latch 14 can be provided without using a pin or the like and at a low cost. Furthermore, the latch 14 can be attached to the housing 13 by simply inserting the latch 14 into the housing 13 by facing forward a side of the latch 14 in which side its tab 144 is connected to the rotary section 143. This makes it easy to attach the latch 14 to the housing 13 without using a specialized processing facility.

Descriptions will be subsequently provided for a part of the housing 13 to which the latch 14 is attached. FIG. 6A is a magnified view of the guide 133 and its periphery in the housing 13. A latch housing 135 that houses the latch 14 is provided inside of the housing 13.

Figure 6:
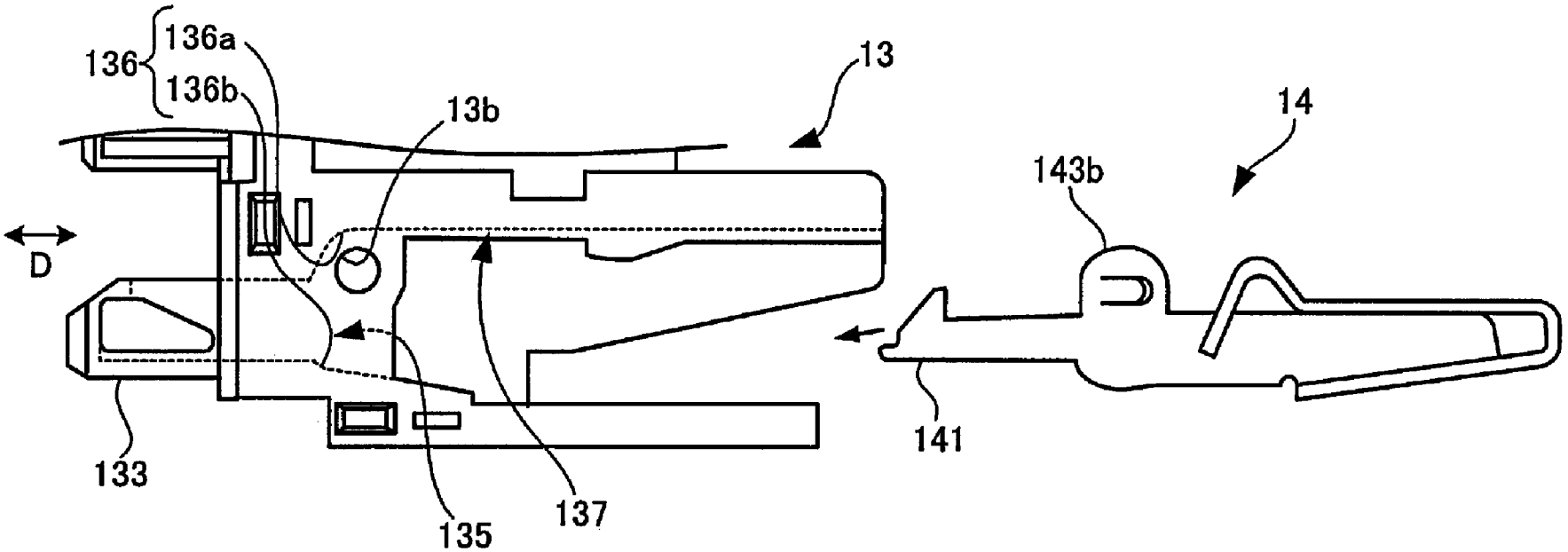
FIG. 6 is an orthogonal view showing a guide and its periphery in a housing of the electrical connector of FIG. 1A.
Figure 7:
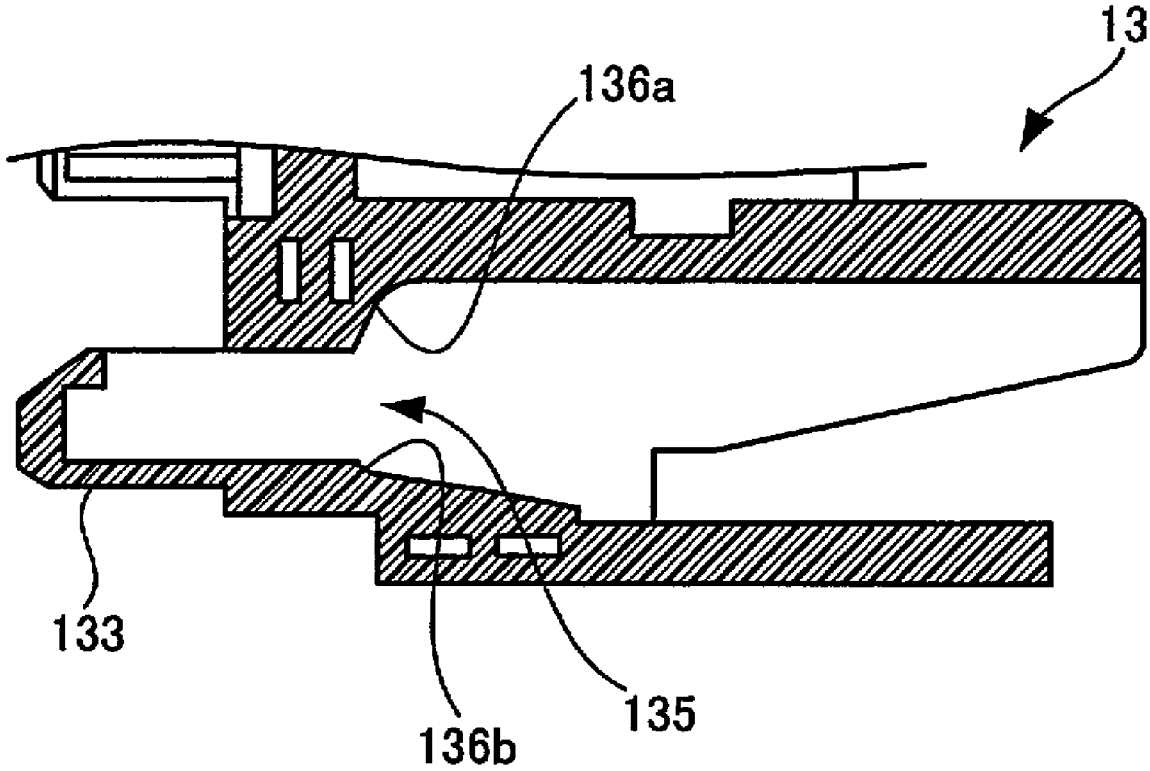
FIG. 7 is a cross-sectional view of the housing of FIG. 6.

FIG. 7 is a cross-sectional view of the housing 13 shown in FIG. 6 at a location of the latch housing 135.

Referring now to FIGS. 6-7, the latch housing 135 is formed to extend into the body 131 in the mating direction D and to continuously reach the inside of the guide 133. The column-shaped supporting openings 13*b* are formed in the housing 13. The supporting openings 13*b* penetrate to the latch housing 135 from the outside of the housing 13. An abutment section 136 consisting of first and second walls 136*a* and 136*b* provided in a periphery of the supporting opening 13*b* in the latch housing 135. The first and second walls 136*a* and 136*b* have shapes which respectively agree with arcs of concentric circles about a point in the supporting opening 13*b*. Furthermore, as shown in FIG. 6, a guide groove 137 continuous from the latch housing 135 is formed in the housing 13 as well.

When the latch 14 is attached to the housing 13 in a step of assembling the electrical connector 1, as shown in FIG. 6, the second curved edge 143*b* of the latch 14 is brought into contact with the guide groove 137, and the latch 14 is pushed and inserted into the latch housing 135 with the lock 141 facing the housing 13. The height of the latch housing 135 is less than the thickness of the latch 14 inclusive of the tab 144. However, the tab 144 is pushed into the latch housing 135 because the latch 14 and the housing 13 are elastically deformed. Once the tab 144 reaches a location of the supporting opening 13*b*, the tab 144 is received by the supporting opening 13*b*, and thus the latch 14 is attached to the housing 13.

Figure 8A:
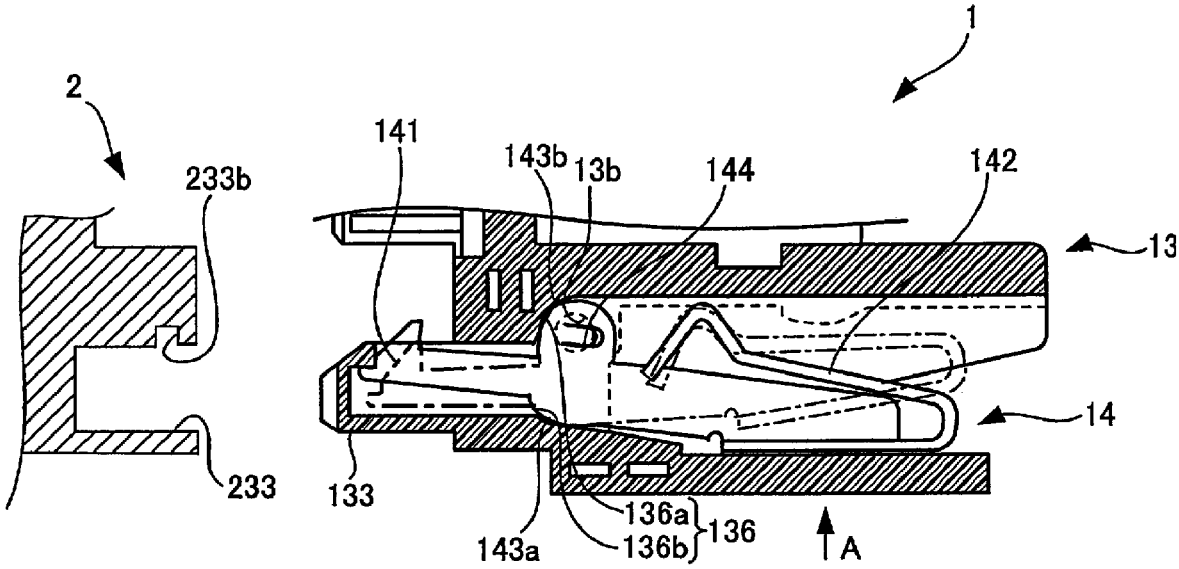
FIG. 8A is a cross-sectional side view of the latch of FIG. 5A oriented for attachment to the housing of the electrical connector of FIG. 1A.
Figure 8B:
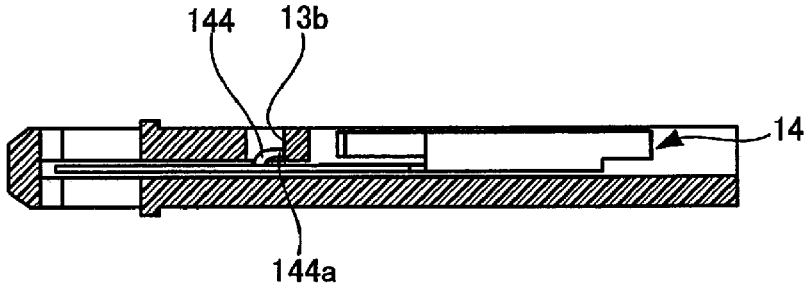
FIG. 8B is a cross-sectional top view of the latch of FIG. 5A oriented for attachment to the housing of the electrical connector of FIG. 1A.

As shown in FIG. 8B, once the tab 144 is received by the supporting opening 13*b*, the tab 144 operates as a rotary shaft about which the latch 14 rotates. A front end 144*a* of the U-shaped tab 144 abuts on the inner wall of the column-shaped supporting opening 13*b* at an almost right angle. In this position, as shown in FIG. 8A, the first and second curved edges 143*a* and 143*b* of the latch 14 respectively abut on the first and second walls 136*a* and 136*b* of the abutment section 136. This prevents the tab 144 from being detached from the supporting opening 13*b*, and accordingly prevents the latch 14 from shifting toward the guide 133, while the latch 14 is being attached to the housing 13.

While the latch 14 is attached to the housing 13, the front end 144*a* of the tab 144, and the first and second curved edges 143*a* and 143*b* are arranged to be distributed in almost equal intervals in a circumferential direction of concentric circles about a point in the supporting opening 13*b*. Furthermore, a portion of the supporting opening 13*b* which abuts the tab 144, the first and second walls 136*a* and 136*b* corresponding to the first and second curved edges 143*a* and 143*b* are arranged to be distributed in almost equal intervals in a circumferential direction of concentric circles about the point in the supporting opening 13*b*.

In the case where the electrical connector 1 is connected to the complementary electrical connector 2, as shown in FIG. 8A, the guide 133 of the electrical connector 1 is inserted into the guide opening 233 of the complementary electrical connector 2. At that time, the lock 141 is pressed by the sidewall of the guide opening 233, and the latch 14 rotates about the point in the supporting opening 13*b* in a direction in which causes the lock 141 to be housed in the guide 133. As a result, the latch 14 is in a posture indicated by the alternate long and short dash line of FIG. 8A. Once the guide 133 is fully inserted into the guide opening 233, the latch 14 rotates in a direction in which the lock 141 juts out from the guide 133 due to a biasing force of the spring 142. As a result, the latch 14 returns to a posture indicated by the continuous line in FIG. 8A.

The latch 14 is securely supported by the abutments at the three locations distributed in the almost equal intervals in the circumference about the rotational center in the supporting opening 13*b*, that is to say, the abutment between the tab 144 and the inner surface of the supporting opening 13*b*, the abutment between the first curved edge 143*a* of the latch 14 and the first wall 136*a*, and the abutment between the second curved edge 143*b* of the latch 14 and the second wall 136*b*.

Furthermore, the inner wall of the supporting opening 13*b*, the first and second walls 136*a* and 136*b* have shapes which are complementary with three arcs of concentric circles about the rotational center in the supporting opening 13*b*. The latch 14 rotates smoothly while sliding the tab 144 and the two first and second curved edges 143*a* and 143*b* on the inner surface of the supporting opening 13*b*, the first wall 136*a* and the second wall 136*b*.

This engagement of the lock 141 and the locking opening 233*b* with each other securely keeps the electrical connector 1 mated with the complementary electrical connector 2 securely.

It should be noted that, although the embodiment has been described citing the electrical connector 1 as an example, the present invention is not limited to this example. The present invention is applicable to any other type of electrical connector, such as the complementary electrical connector.

In addition, although the embodiment has been described citing the column-shaped supporting opening 13*b* as an example of a member which receives the tab 144, the present invention is not limited to this example. Any other member serves the purpose of receiving the tab 144, as long as the member is a circular concave section. For example, a spherical concave or the like may be provided to the latch housing 135, and be used as the member which receives the tab 144.

Moreover, although the embodiment has been described using the example in which the abutment section 136 abutting on the first and second curved edges 143*a* and 143*b* is constituted of the first and second walls 136*a* and 136*b*, the present invention is not limited to this example. The number of wall sections abutting on each of the arc-shaped edges may be one, or three or more.

What is claimed is:

1. An electrical connector for connection to a complementary electrical connector, the electrical connector comprising:

a housing comprising a column-shaped concavity;

a latch being formed of metal and rotatably carried by the housing, the latch comprising a rotary section having a first curved edge, a second curved edge, and a tab that is received by the concavity, the latch further comprising a lock extending from the rotary section for connection with the complementary electrical connector; and the housing including an abutment section having a first wall shaped complementarily to the first curved edge and contacting the first curved edge and a second wall shaped complementarily to the second curved edge and contacting the second curved edge, the first and second walls each comprising a shape that lies substantially along circles concentric to a circle about a point within the column-shaped concavity;

wherein the tab has a hook-like shape and is substantially U-shaped at its front end, which abuts on an inner wall of the column-shaped concavity wherein the tab is formed as a portion of the rotary section being sheared and bent.

2. The electrical connector according to claim 1, wherein the tab is rotatably supported by the concavity.

3. The electrical connector according to claim 1, wherein a substantial portion of the tab lies substantially parallel to a portion of the rotary section that does not form the tab.

4. The electrical connector according to claim 1, wherein the concavity is a circular concavity.

5. The electrical connector according to claim 1, wherein the concavity is a spherical concavity.

6. The electrical connector according to claim 1, wherein the concavity is a hole.

7. The electrical connector according to claim 1, the latch further comprising:

a spring extending from the rotary section substantially opposite the lock.

8. The electrical connector according to claim 7, wherein the spring is biased in a direction substantially orthogonal to a mating direction.

9. The electrical connector according to claim 8, wherein the lock is biased in a direction substantially opposite to the direction in which the spring is biased.

10. The electrical connector according to claim 1, further comprising:

a mating plate extending from the housing in a mating direction;

first contacts carried by the mating plate; and second contacts carried by the mating plate.

11. The electrical connector according to claim 10, wherein the first contacts and second contacts are arranged in a staggered manner in a row along the mating plate.

12. The electrical connector according to claim 10, wherein the first contacts and second contacts are positioned on opposing sides of the mating plate.

13. The electrical connector according to claim 10, wherein the tab is substantially captured within the concavity.

* * * * *